US006091385A

United States Patent [19]

Shigeta

[11] Patent Number: 6,091,385

[45] Date of Patent: Jul. 18, 2000

[54] INTEGRATED CIRCUIT FOR DRIVING FLAT DISPLAY DEVICE

[75] Inventor: Yoshihiro Shigeta, Nagano, Japan

[73] Assignee: Fuji Electric Co., Ltd., Japan

[21] Appl. No.: 08/969,959

[22] Filed: Nov. 25, 1997

[30] Foreign Application Priority Data

Nov. 28, 1996 [JP] Japan ..... 8-317467

[51] Int. Cl.[7] ..... G09G 3/30; G09G 3/36

[52] U.S. Cl. ..... 345/79; 345/84; 345/87; 345/90; 345/91; 345/92

[58] Field of Search ..... 345/84, 87, 90, 345/91, 92, 61, 76, 79

[56] References Cited

U.S. PATENT DOCUMENTS 5,627,556 5/1997 Kwon et al. ..... 345/76

5,739,641 4/1998 Nakamura ..... 345/61

5,838,289 11/1998 Saito et al. ..... 345/79

*Primary Examiner*—Vijay Shankar

*Assistant Examiner*—Mortaza Zarakhsh

*Attorney, Agent, or Firm*—Rossi & Associates

[57] ABSTRACT

An integrated circuit for driving a flat display device having a plurality of scanning electrodes is provided. The integrated circuit includes a plurality of output circuits each of which includes a charging device and a discharging device that control and drive a corresponding scanning electrode of the flat display device, and a charging diode and a discharging diode that cause an external common control device to control and drive the scanning electrodes. In this integrated circuit, an electrode portion constituting an output terminal of the output circuit is located between the charging diode and the discharging diode.

2 Claims, 5 Drawing Sheets

INTEGRATED CIRCUIT FOR DRIVING FLAT DISPLAY DEVICE

FIELD OF THE INVENTION

The present invention relates to an integrated circuit for driving a flat display device, and in particular to such an integrated circuit that drives a plasma display panel used as a large-sized flat display device.

BACKGROUND OF THE INVENTION

As the size of image display devices has increased in recent years, there has been an increasing demand for flat display devices that use their flat-type plasma display panels to provide large display screens. In a plasma display panel for a television, for example, discharge cells are provided between vertical arrays of electrodes and lateral arrays of electrodes, and images are formed by turning on/off the discharge cells for gas discharge at intersections of the electrodes corresponding to selected display pixels.

FIG. 5 is a schematic block diagram showing a peripheral portion for driving the plasma display panel. In FIG. 5, the plasma display panel 10 includes X electrodes 12 and Y electrodes 14 that are alternately arranged in parallel with each other to extend in the horizontal direction. The X electrodes 12 are connected to each other at one end to provide a common electrode, and the Y electrodes 14 are individually controlled independently of each other. The plasma display panel 10 further includes address electrodes 16 that extend in the vertical direction, i.e., perpendicular to the X electrodes 12 and Y electrodes 14. The X electrodes 12 of the plasma display panel 10 are connected to an X-side common driver 18, and the Y electrodes 14 are connected to a Y scanning driver 20, which is in turn connected to a Y-side common driver 22 for controlling the Y electrodes 14 via the Y scanning driver 20. The addressing electrodes 16 of the plasma display panel 10 are connected to an addressing driver 24.

When displaying one field of image on the plasma display panel 10 constructed as described above, the respective drivers 18, 20, 22, 24 drive the corresponding electrodes 12, 14, 16 in three modes corresponding to a reset period, addressing period and discharge sustaining period. Initially, in the reset period, the Y-side common driver 22 and X-side common driver 18 alternately apply pulses to all of the Y electrodes 14 and X electrodes 12, to sustain discharge of the discharge cells and thereby perform batch writing, and then the X-side common driver 18 applies erasing pulses only to the X electrodes 12 so as to erase all information stored in all of the discharge cells. In the next addressing period, the X-side common driver 18 and Y scanning driver 20 apply voltage to the X electrodes 12 and all of the Y electrodes 14. In this period, the Y scanning driver 20 successively applies scan pulses to the respective Y electrodes 14. In the meantime, the addressing driver 24 successively applies address pulses to selected address electrodes corresponding to the discharge cells to be turned on. As a result, addressing discharge occurs at the selected discharge cells so that the locations of the selected cells are stored by charge storage. In the subsequent discharge sustaining period, the X-side common driver 18 and Y-side common driver 22 apply sustaining pulses alternately to the X electrodes 12 and Y electrodes 14, to sustain discharge of the discharge cells that have been addressed for discharge so as to maintain the display.

The Y scanning driver 20, which is adapted to independently control the respective Y electrodes 14, is constituted by an integrated circuit on which output circuits for driving the respective electrodes are integrated. Each of the output circuits includes a device that functions to charge and discharge one of the Y electrodes 14 during the addressing period, and a device that functions to cause the Y-side common driver 22 to charge and discharge all of the Y electrodes 14 during the reset period and discharge sustaining period. With regard to drive current flowing through the respective devices, current of about 100 mA flows through the device for driving each of the Y electrodes 14 during the addressing period, and current as large as about 400 mA flows through the device for driving all of the Y electrodes 14 during the reset period and discharge sustaining period. To produce the integrated circuit including such devices, a mask is designed to provide a pattern configuration as shown in FIG. 6, and a chip having a cross section as shown in FIG. 7 is produced based on the pattern configuration of FIG. 6, for example.

FIG. 6 is a view showing an example of the pattern configuration of the output circuit for one output, and FIG. 7 is a view showing the cross section of the chip of the output circuit for one output. In these figures, charging device 30 and discharging device 32 used during the addressing period, charging diode 34 and discharging diode 36 used during the reset period and discharge sustaining period, and an electrode portion 38 on the chip are arranged in one row, to thus constitute the output circuit for one output. In practice, a plurality of similar output circuits are arranged in parallel with the output circuit having the above-described configuration.

As shown in FIG. 7, wiring is patterned on the devices formed in a substrate with an interlayer insulating film 42 interposed between the devices and the patterned wiring, such that terminals of the respective devices (portions indicated by small back rectangles in FIG. 6) are connected to each other, and also connected to the corresponding devices of the other output circuits. In the resulting wiring patterning are formed a wire 44 as a power supply line commonly connected to the charging devices 30 of the respective output circuits, a wire 46 as a ground line commonly connected to the discharge devices 32 of the output circuits, and wires 48, 50 as lines through which the charging diodes 34 and discharging diodes 36 of the output circuits are commonly connected to the Y-side common driver 22. Further, a wire 54 serving as an output line of the output circuit is formed on an interlayer insulating film 52 over the interlayer insulating film 42, such that the wire 54 is protected by a protective film 56 except its portion corresponding to the electrode portion 38.

Generally, the electrode portion 38 is located at the closest position to a scribe line along which individual chips are cut from a wafer, so that wire bonding can be conduced with a reduced distance between the electrode portion 38 and a lead. The charging diode 34 and discharging diode 36 that handle large current are located close to this electrode portion 38, so that the patterned wiring for the large current can be shortened.

In the conventional pattern configuration of the output circuit for driving one of scanning electrodes of the plasma display panel, the two devices through which the current flows most during the reset period and discharge sustaining period are arranged in alignment with the electrode portion located closest to the scribe line. Therefore, the wire extending between one of the two diodes and the electrode portion becomes longer than that extending between the other diode and the electrode portion. Also, these wires intersect with the wires commonly connected to the Y-side common driver.

Since the height of the wires for the large current is limited at the intersecting locations, the areas of wires and through-holes are inevitably increased in the pattern, resulting in an increase in the chip size. This may affect characteristics of the chip, and increase the cost of the chip.

SUMMARY OF THE INVENTION

It is therefore an object of the present invention to provide an integrated circuit for driving a flat display device, wherein the number of wires which lead to electrode portions as output terminals of output circuits and intersect with wires through which large current flows can be reduced to the minimum, assuring reduced size and cost of chips.

The above object may be accomplished according to the principle of the present invention, which provides an integrated circuit for driving a flat display device having a plurality of scanning electrodes, which integrated circuit comprises a plurality of output circuits each including a charging device and a discharging device that control and drive a scanning electrode of the flat display device, and a charging diode and a discharging diode which cause an external common control device to control and drive the scanning electrodes, wherein an electrode portion constituting an output terminal of the output circuit is located between the charging diode and the discharging diode.

In the integrated circuit constructed as described above, the charging diode, discharging diode and electrode portion of each output circuit are arranged in one row such that the electrode portion is interposed between the charging and discharging diodes. Therefore, wires extending from the charging diode and discharging diode to the electrode portion are uniformly shortened in length, and do not intersect with other wires through which large current flows. Thus, the area of the wires connected to the electrode portion can be reduced, and the chip size can be accordingly reduced.

BRIEF DESCRIPTION OF THE DRAWINGS

The invention will be described in greater detail with reference to a preferred embodiment thereof and the accompanying drawings, wherein.

DETAILED DESCRIPTION OF THE PREFERRED EMBODIMENT

One embodiment of the present invention will be described when it is applied to scanning electrode drive circuits of a plasma display panel.

Figure 3:
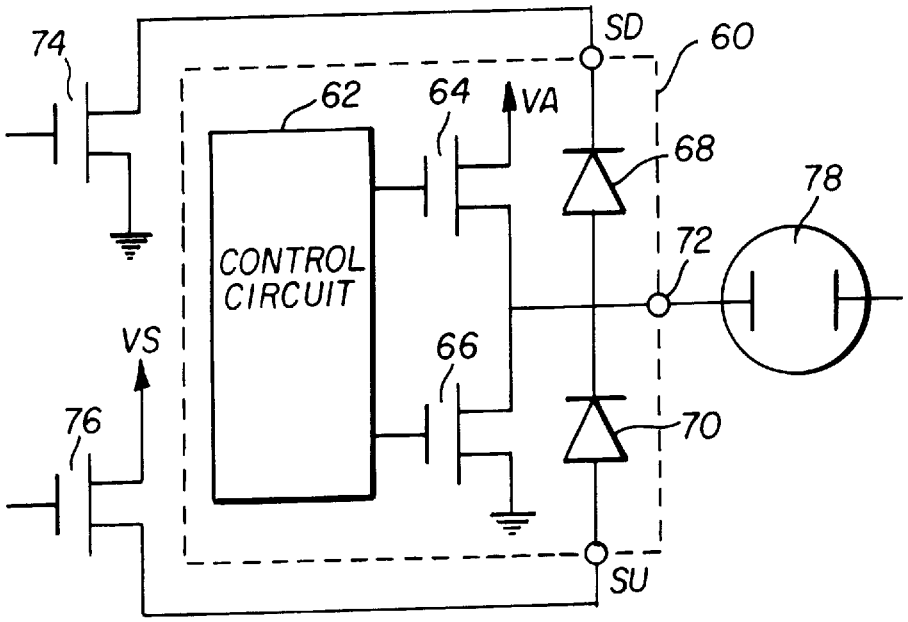
FIG. 3 is a view showing an equivalent circuit of an output circuit for driving a scanning electrode.

FIG. 3 is a view showing an equivalent circuit of an output circuit for driving a scanning electrode. The output circuit 60 includes a control circuit 62, two field-effect transistors 64, 66 and two diodes 68, 70. The transistor 64 has a source terminal connected to a power supply line of voltage VA, and a drain terminal connected to an output terminal 72. The transistor 66 has a drain terminal connected to the output terminal 72, and a source terminal connected to a ground terminal (GND). The diode 68 has an anode terminal connected to the output terminal 72, and a cathode terminal that is connected to a drain terminal of an external power MOS field-effect transistor 74 via a terminal SD. The diode 70 has a cathode terminal connected to the output terminal 72, and an anode terminal that is connected to an external power MOS field-effect transistor 76 via a terminal SU. The output terminal 72 of the output circuit 60 is connected to one of Y electrodes which constitutes a discharge cell 78 corresponding to one pixel in the plasma display panel. The source terminal of the transistor 74 is grounded, and the source terminal of the transistor 76 is connected to a power supply line of voltage VS. In this arrangement, the transistors 64, 66 correspond to a charging device and a discharging device, respectively, and the two diodes 68, 70 correspond to a discharging diode and a charging diode, respectively. Also, the output circuit 60 is equivalent to one circuit for driving one Y electrode in Y scanning driver, and the transistors 74, 76 are equivalent to Y-side common driver.

The control operation for driving the plasma display panel will be now described. Initially, in the reset period, the transistor 74 is turned on and the output terminal 72 is grounded when writing pulses and erasing pulses are applied to the X electrodes, and the transistor 76 is turned on and the potential of the output terminal 72 is raised to the level of voltage VS at intervals between the writing pulses and erasing pulses. The drive current in this reset period is about 400 mA. In the addressing period, the transistor 64 of the output circuit 60 is kept in the ON state almost throughout this period so that the potential of the output terminal 72 is made equal to the level of voltage VA, and the transistor 64 is turned off and the transistor 66 is turned on so as to ground the output terminal 72 only during the periods in which scanning pulses are applied. The drive current during this addressing period is about 100 mA. In the discharge sustaining period, the transistors 74, 76 are alternately turned on and off so as to give sustaining pulses to the output terminal 72, thereby to sustain or maintain discharge of the discharge cells that were selectively discharged during the addressing period. The drive current in this discharge sustaining period is about 400 mA.

Figure 1:
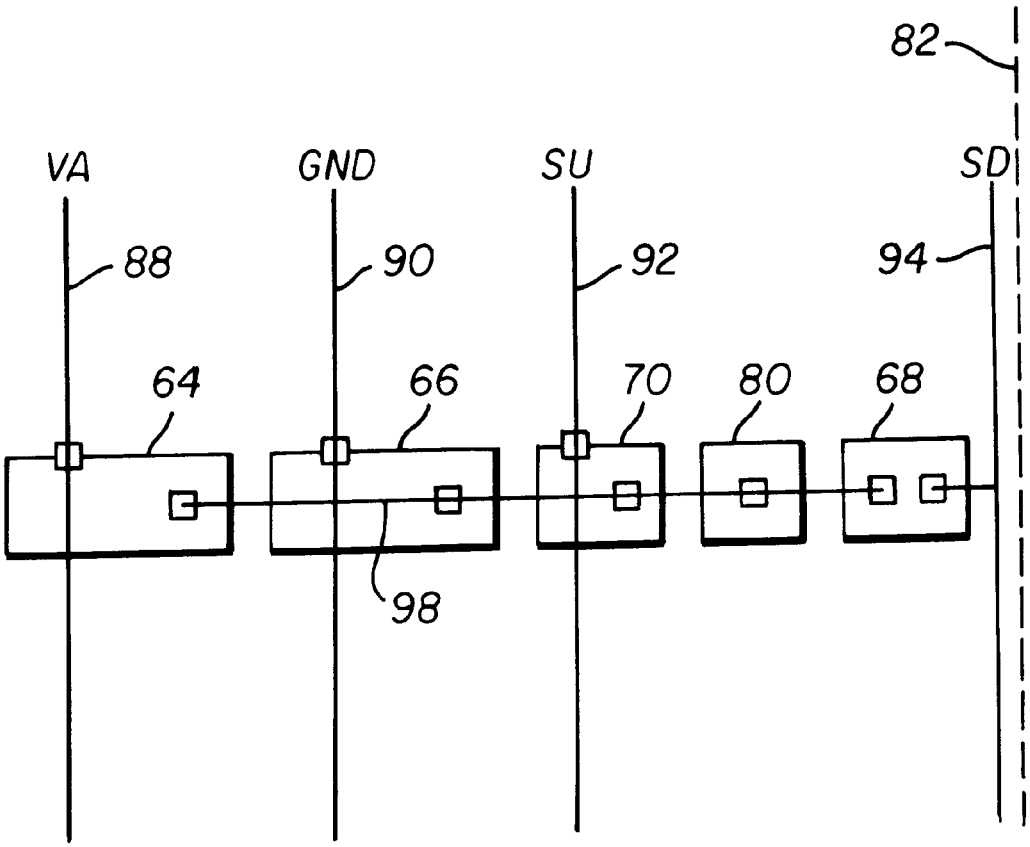
FIG. 1 is a view showing the pattern configuration of an output circuit for one output according to the present invention.
Figure 2:
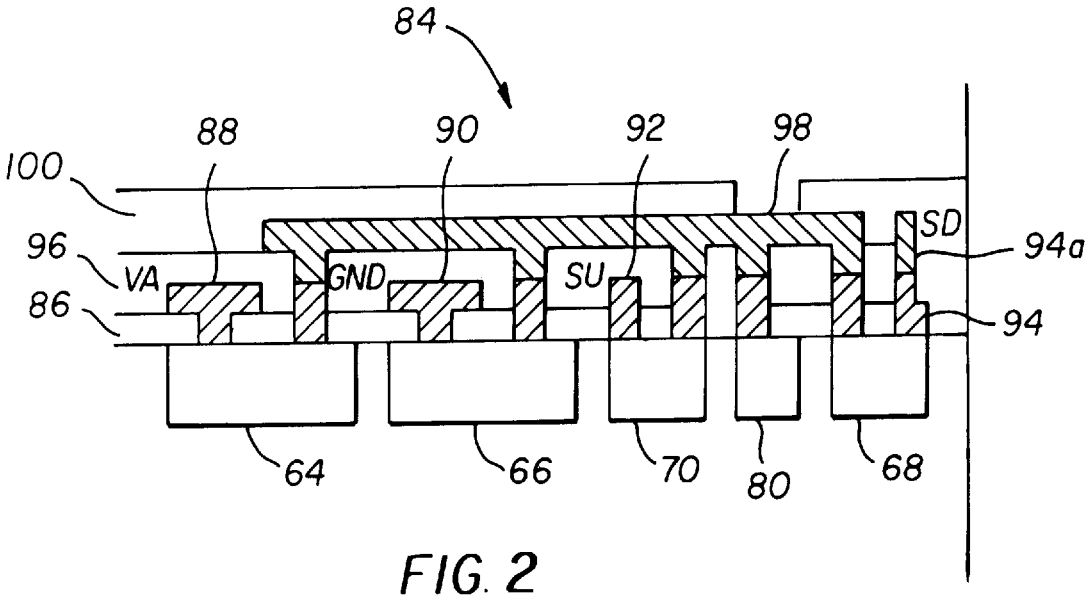
FIG. 2 is a view showing a cross section of a chip having the output circuit for one output.

When producing an integrated circuit including the output circuit 60 as described above, a mask is designed to provide a pattern configuration as shown in FIG. 1, and a chip having a cross section as shown in FIG. 2 is produced based on the pattern configuration of FIG. 1.

FIG. 1 is a view showing the pattern configuration of the output circuit for one output, and FIG. 2 is a view showing the cross section of the chip having the output circuit for one output. As shown in these figures, the transistors 64, 66, diode 70, electrode portion 80 and diode 68 are arranged in one row. More specifically, the electrode portion 80 that constitutes the output terminal 72 of the output circuit 60 is located between the diode 68 and the diode 70. In this embodiment, the diode 68 is located closer to a scribe line 82 than the electrode portion 80. While only a pattern for one output is shown in FIGS. 1 and 2, a plurality of output circuits having the same configuration are actually arranged parallel to the array of the devices in this output circuit.

The transistors 64, 66, diodes 68, 70 and electrode portion 80 as described above are formed in a substrate 84, and a first wiring layer formed of aluminum is patterned on an interlayer insulating film 86 over these devices 64, 66, 68, 70, 80, to thus form a wire 88 of voltage VA, wire 90 for grounding (GND), and wires 92, 94 connected to the terminals SU, SD leading to the Y-side common driver. Further, a second wiring layer formed of aluminum is patterned on an interlayer insulating film 96 over the interlayer insulating film 86, to thus form a wire 98 serving as an output line of the transistors 64, 66 and diodes 68, 70 that are commonly connected to the electrode portion 80 that constitutes the output terminal 72. The wiring pattern of this second wiring layer also includes a wire 94*a* that is superposed on the wire 94. In addition, a protective film 100 is formed the interlayer insulating film 96 to cover the wires 98, 94A, except a portion of the wire 98 corresponding to the electrode portion 80 which is used for wire bonding. It is to be noted that the devices and wires shown in FIG. 1 and FIG. 2 are somewhat exaggerated, and the ratio of dimensions of these devices and wires is different from that of actual dimensions thereof In the arrangement as described above, the electrode portion 80 is interposed between the diode 68 and the diode 70, thus making it possible to uniformly shorten the wires between the diode 68 and diode 70 through which large current flows, and the electrode portion 80. Further, there is no wire intersecting with a portion of the common wire 98 located between the diodes 68, 70.

The current flowing through the wire 98 connecting the diode 68, electrode portion 80 and diode 70 and the wires 92, 94 leading to the Y-side common driver is about 400 mA. Where the aluminum wires have an allowable current of $5\times10^5$ A/cm$^2$ and a thickness of 1 $\mu$m, the wire width becomes 200 $\mu$m.

Since the wire 94 connected to the diode 68 on the side of the scribe line 82 and leading to the Y-side common driver has no intersecting portion, the second wiring layer may be used with this wire 94, namely, the wire 94*a* of the second wiring layer may be superposed on the wire 94 of the first wiring layer. In this case, if the wire 94*a* of the second wiring layer has the same thickness, i.e., 1 $\mu$m, the thickness of the wiring is doubled, and therefore the width of the wiring can be made equal to 100 $\mu$m that is one half of the above-indicated width.

Figure 4:
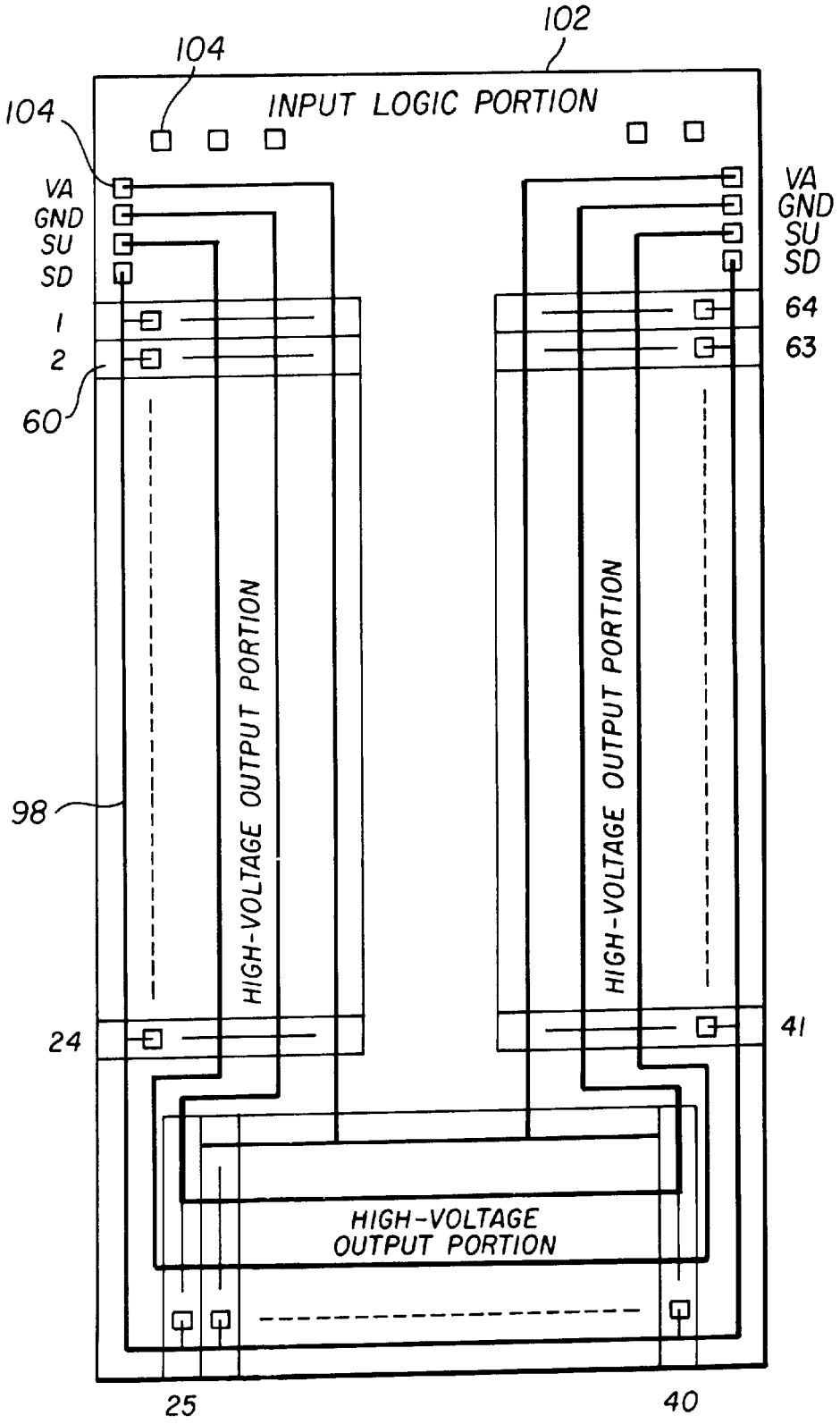
FIG. 4 is a view showing the whole construction of an integrated circuit on which output circuits for driving scanning electrodes are integrated.
Figure 5:
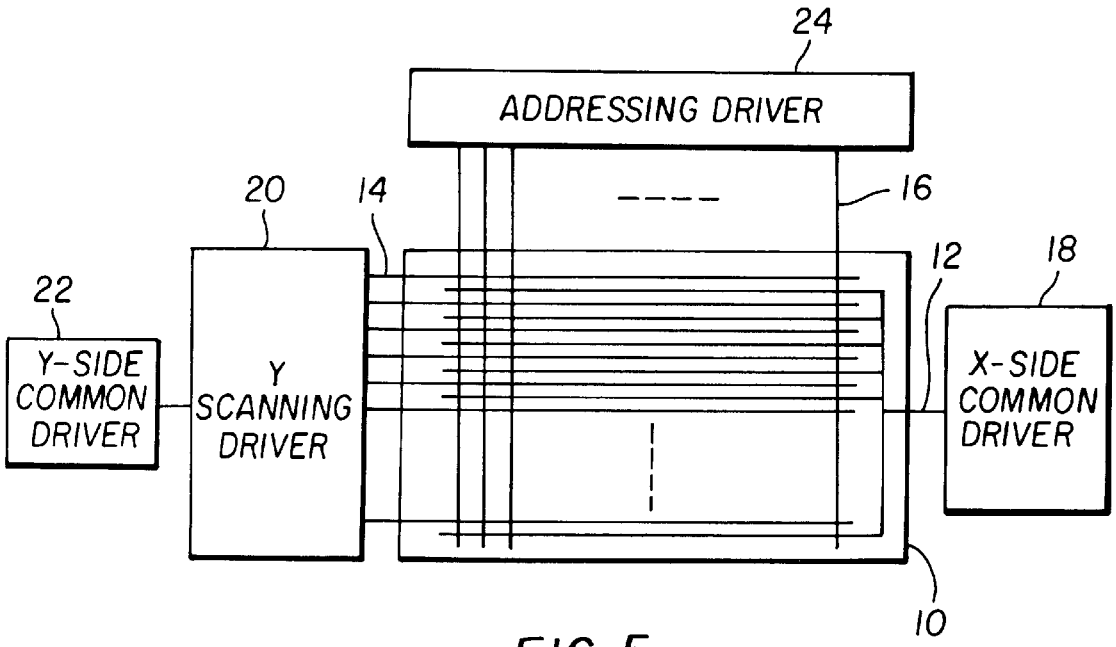
FIG. 5 Prior Art
FIG. 5 is a schematic block diagram showing a peripheral portion for driving a plasma display panel.
Figure 6:
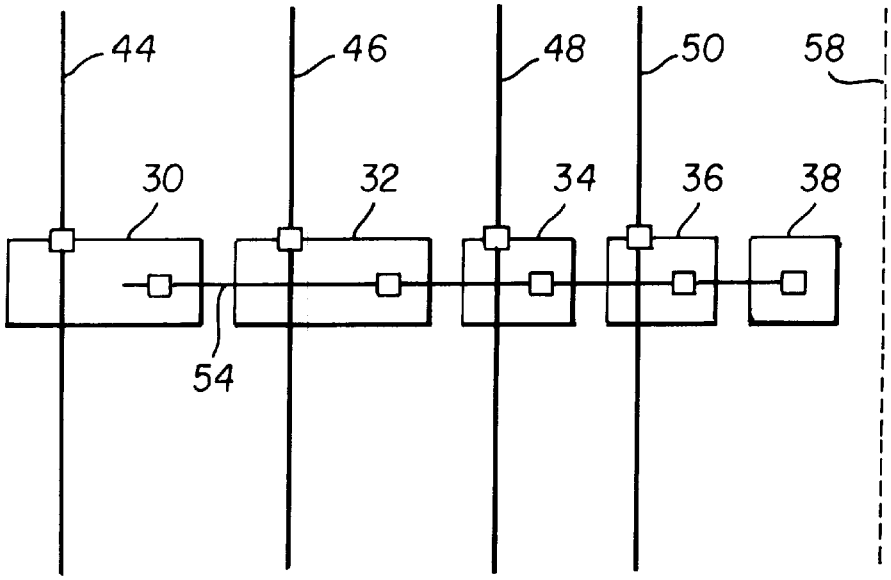
FIG. 6 Prior Art
FIG. 6 is a view showing an example of pattern configuration of an output circuit for one output.
Figure 7:
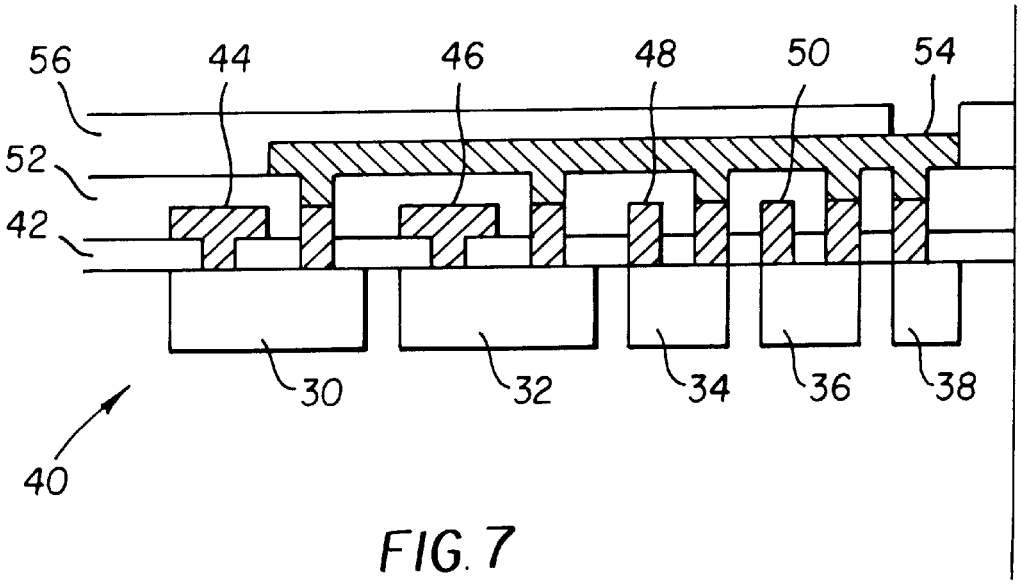
FIG. 7 Prior Art
FIG. 7 is a view showing a cross section of a chip having the output circuit for one output.

FIG. 4 is a view showing the whole construction of the integrated circuit on which output circuits for driving scanning electrodes are integrated. In the integrated circuit 102 shown in FIG. 4, sixty-four output circuits 60 are divided into three groups of high-pressure output portions that are located on three sides of the circuit 102. In FIG. 4, small squares represent electrode portions 104 to which thin wires are attached under pressure during wire bonding, and the electrode portions labeled "VA", "GND" for the power supply line and ground line, respectively, and the electrode portions labeled "SU" and "SD" for the Y-side common driver are located close to and along the outer periphery of the integrated circuit 102. In the portions on which the output circuits are located, on the other hand, the wire 94 leading to the electrode portion "SD" is located close to the outer periphery of the integrated circuit 102, and the electrode portions of the respective output circuits are located inside the wire 94.

Thus, the electrode portions of the output circuits are located inside the other electrode portions of the integrated circuit, with a result of an increased distance between the scribe line of the chip and the electrode portions of the output circuits. While the distance between the other electrode portions and the scribe line is in a range of about 100 to 200 $\mu$m, the distance between the electrode portions of the output circuits 60 and the scribe line is in a range of about 400 to 500 $\mu$m. However, the distance in the latter range as well as the former range does not cause any problem when conducting wire bonding with the current wire bonding technology.

While the discharging diode 68 is located on the side of the scribe line in the embodiment of FIG. 1, the charging diode 70 may be located between the electrode portion 80 and the scribe line.

As described above, according to the present invention, the electrode portion that constitutes the output terminal of the output circuit is located between the charging diode and the discharging diode. In this arrangement, the wires between the two diodes through which large current flows and the electrode portion are uniformly shortened. Also, the wire connecting the diodes of plural output circuits which are located on the side of the scribe line does not intersect with any other wire, thus making it possible to superpose the second wiring layer on the first wiring layer. If each wire has same thickness, therefore, the width of the wire can be reduced to one half, thus reducing the chip size of the integrated circuit.

What is claimed is:

1. An integrated circuit for driving a flat display device having a plurality of scanning electrodes, said integrated circuit comprising:

a plurality of output circuits, each output circuit including a charging device and a discharging device that control and drive a corresponding one of the scanning electrodes of the flat display device, and a charging diode and a discharging diode that cause an external common control device to control and drive the scanning electrodes;

wherein an electrode portion constituting an output terminal of said output circuit is located between said charging diode and said discharging diode; and wherein at least one of said charging diode and discharging diode is located closer to a scribe line than said electrode portion and has a first terminal connected to said electrode portion and a second terminal connected in common to said plurality of output circuits, wherein said first terminal is located closer to said electrode portion than said second terminal, and wherein said second terminal is connected to a common wire located closer to said scribe line than said first terminal.

2. An integrated circuit as defined in claim 1, wherein said common wire is formed by superposing a first wiring layer and a second wiring layer on each other.

* * * * *